United States Patent [19]

Nilssen

[11] Patent Number: 4,893,059

[45] Date of Patent: Jan. 9, 1990

[54] ELECTRONIC BALLAST WITH SAFETY FEATURE

[76] Inventor: Ole K. Nilssen, Caesar Dr., Rte. 5, Barrington, Ill. 60010

[21] Appl. No.: 830,739

[22] Filed: Feb. 19, 1986

[51] Int. Cl.[4] ..... H05B 44/14

[52] U.S. Cl. ..... 315/127; 315/209 R; 315/224; 315/DIG. 5

[58] Field of Search ..... 315/209 R, 209 T, 225, 315/226, 220, DIG. 5, DIG. 7, 106, 127, 121; 361/42, 45, 46; 363/97

[56] References Cited

U.S. PATENT DOCUMENTS

| | | | |
|---|---|---|---|
| 4,256,992 | 3/1981 | Luursema | 315/106 |
| 4,277,726 | 7/1981 | Burke | 315/DIG. 5 |
| 4,398,126 | 8/1983 | Zuchtriegel | 315/121 |
| 4,430,628 | 2/1984 | Nilssen | 315/DIG. 5 |
| 4,461,980 | 7/1984 | Nilssen | 315/225 |
| 4,503,363 | 3/1985 | Nilssen | 315/225 |
| 4,507,698 | 3/1985 | Nilssen | 315/DIG. 7 |
| 4,554,487 | 11/1985 | Nilssen | 315/225 |

*Primary Examiner*—James J. Groody
*Assistant Examiner*—Mark R. Powell

[57] ABSTRACT

An electronic ballast provides a high-frequency current-limited voltage between a pair of socket terminals. These socket terminals are adapted to receive and hold a rapid-start fluorescent lamp. A person coming in direct or indirect contact with one of these terminals may receive a hazardous electric shock.

A self-oscillating electronic inverter is operable to provide the high-frequency voltage. To provide an output, this inverter has to be triggered into oscillation. However, except if current flows into both socket terminals, the inverter will automatically become disabled within 25 milli-seconds; whereafter it will not be re-triggered for about 1.5 seconds.

With no current flowing, the magnitude of the high-frequency AC voltage is high enough to permit proper starting of a the rapid-start fluorescent lamp within a time span of 25 milli-seconds, but only after its cathodes have become incandescent. As soon as the lamp has started, lamp current flows into the socket terminals and through the fluorescent lamp.

If lamp current to either or both lamp terminals fails to flow, or if interrupted, as for instance may happen when replacing the fluorescent lamp, the inverter becomes disabled; which means that the electric shock hazard represented by the lamp terminals will be removed within 25 milli-seconds.

16 Claims, 1 Drawing Sheet

ELECTRONIC BALLAST WITH SAFETY FEATURE

BACKGROUND OF THE INVENTION

1. Field of Invention

The present invention relates to fluorescent lamp ballasts, particularly of a type providing protection from electric shock hazard to a person servicing lighting fixtures in which such ballasts are used.

2. Prior Art

In electronic fluorescent lamp ballasts of prior art, electric shock protection is generally accomplished by powering the fluorescent lamps by way of an isolation transformer. However, there are several drawbacks associated with the use of an isolation transformer: (i) substantial additional cost, (ii) significantly added weight and volume, and (iii) sizable reduction in overall efficiency.

Another approach to providing electric shock hazard protection is that of reducing the magnitude of the ballast output voltage in case the lamp is removed from its output. Such an approach is described in U.S. Pat. No. 4,461,980 to Nilssen. However, the particular method described by Nilssen in that patent does not provide protection in a situation where a person may be in contact between ground and the "hot" side of the ballast output, and if that person should then happen to draw enough current from that "hot" side to provide significant loading of the ballast output.

Still another approach to providing electric shock hazard protection is that of reducing the magnitude of the ballast output voltage in case a ground-fault current occurs. This approach is described in U.S. Pat. No. 4,507,698 to Nilssen. However, while this approach is indeed fully operable and does indeed significantly mitigate the several drawbacks associated with the use of an isolation transformer, there are complexities involved with accurately and inexpensively sensing the ground-fault current.

SUMMARY OF THE INVENTION

OBJECTS OF THE INVENTION

An object of the present invention is that of providing a fluorescent lamp ballast for a lighting apparatus, wherein this ballast is operative to reduce the possibility of a person receiving a severe electric shock when servicing this lighting apparatus.

This as well as other objects, features and advantages of the present invention will become apparent from the following description and claims.

BRIEF DESCRIPTION

In its preferred embodiment, the present invention constitutes an electronic ballast that provides a high-frequency current-limited voltage between a first pair of socket terminals and a second pair of socket terminals. These pairs of socket terminals are adapted to receive and hold a rapid-start fluorescent lamp. Either or both terminal pairs may have a relatively high-magnitude potential relative to ground; and a person coming in direct or indirect contact with such a terminal pair is apt to receive a hazardous electric shock.

A self-oscillating electronic inverter is operable to provide the high-frequency voltage. To provide an output, this inverter has to be triggered into oscillation. However, except if current flows into both terminal pairs, the inverter will automatically become disabled within about 25 milli-seconds; whereafter it will not be re-triggered for about 1.5 seconds.

With no current flowing, the magnitude of the high-frequency AC voltage is high enough to permit proper starting of a the rapid-start fluorescent lamp within a time span of 25 milliseconds, but only after its cathodes have become incandescent. As soon as the lamp has started, lamp current flows into both socket terminal pair and through the fluorescent lamp.

If lamp current to either terminal pair fails to flow, or if it is interrupted, as for instance may happen when replacing the fluorescent lamp, the inverter becomes disabled; which means that the electric shock hazard represented by the terminal pairs will be removed within about 25 milli-seconds, thereafter not to re-occur until after about 1.5 seconds.

DESCRIPTION OF THE PREFERRED EMBODIMENT

Details of Construction

Figure 1:
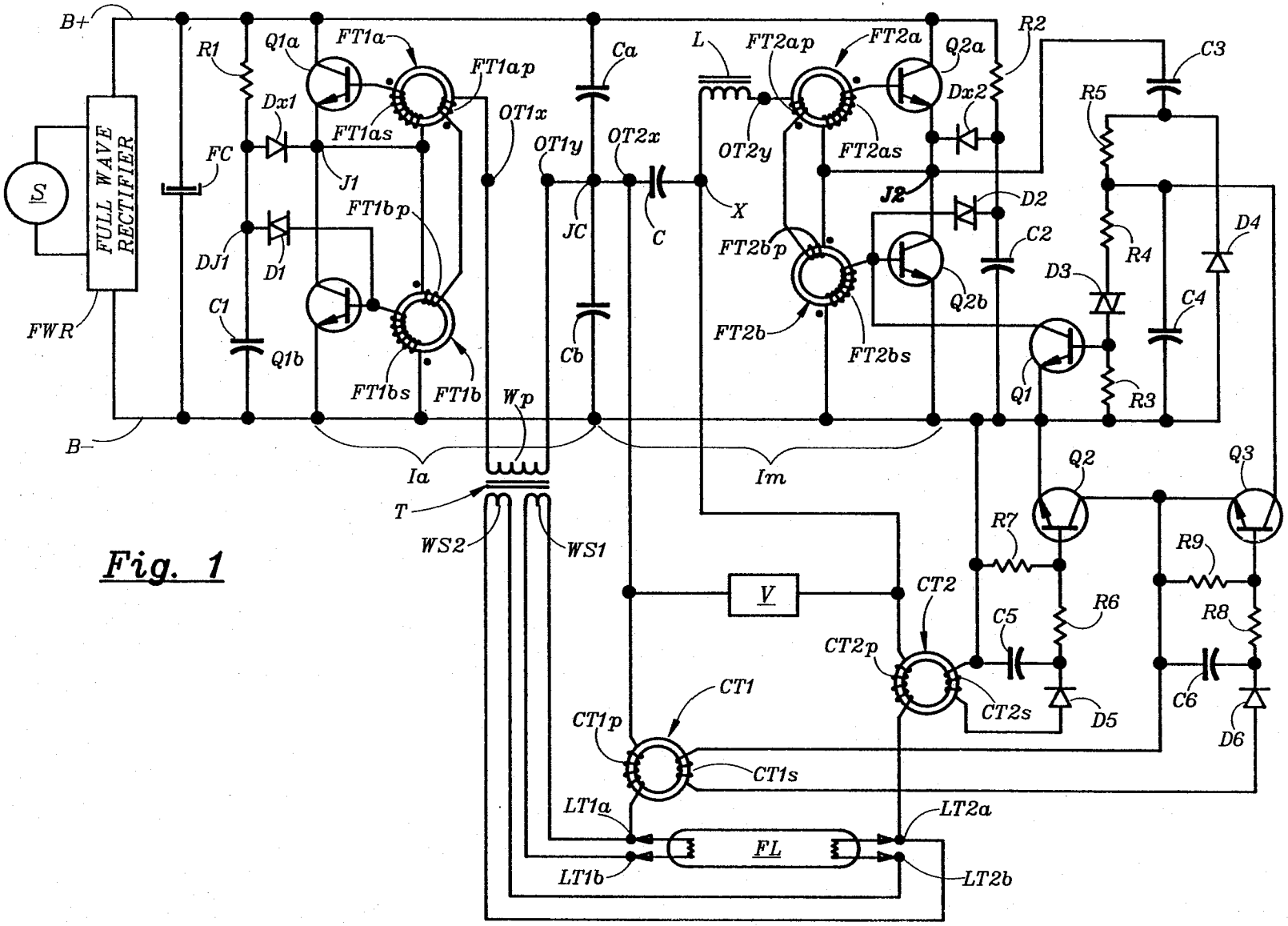
FIG. 1 illustrates the preferred embodiment of the invention and shows a first inverter operative to provide cathode heating for a fluorescent lamp, and a second inverter operative to controllably provide main operating power to the same fluorescent lamp.

FIG. 1 illustrates the preferred embodiment of the invention and shows an AC voltage source S, which in reality is an ordinary 120 Volt/60 Hz electric utility power line.

Connected to S is a full-wave rectifier FWR that rectifies the AC voltage from S to provide a substantially constant-magnitude DC voltage between a positive power bus B+ and a negative power bus B−. A filter capacitor FC is connected between the B+ bus and the B− bus.

A first pair of transistors Q1*a* and Q1*b* are connected in series between the B+ bus and the B− bus in such a way that the collector of Q1*a* is connected to the B+ bus, the emitter of Q1*a* is connected with the collector of Q1*b* at a junction J1, and the emitter of Q1*b* is connected with the B− bus.

A second pair of transistors Q2*a* and Q2*b* are connected in series between the B+ bus and the B− bus in such a way that the collector of Q2*a* is connected to the B+ bus, the emitter of Q2*a* is connected with the collector of Q2*b* at a junction J2, and the emitter of Q2*b* is connected with the B− bus.

Primary winding FT1*ap* of saturable feedback transformer FT1*a* and primary winding FT1*bp* of saturable feedback transformer FT1*b* are connected in series between junction J1 and output terminal OT1*x*. Another output terminal OT1*y* is connected with junction JC between capacitors Ca and Cb; which capacitors are connected in series between the B+ bus and the B− bus.

Primary winding FT2*ap* of saturable feedback transformer FT2*a* and primary winding FT2*bp* of saturable feedback transformer FT2*b* are connected in series between junction J2 and output terminal OT2*y*. Another output terminal OT2*x* is connected with junction JC.

Secondary winding FT1*as* of feedback transformer FT1*a* is connected between the base and the emitter of transistor Q1*a*; and secondary winding FT1*bs* of feedback transformer FT1*b* is connected between the base and the emitter of transistor Q1*b*.

Secondary winding FT2*as* of feedback transformer FT2*a* is connected between the base and the emitter of transistor Q2*a*; and secondary winding FT2*bs* of feedback transformer FT2*b* is connected between the base and the emitter of transistor Q2*b*.

A capacitor C is connected between output terminal OT2*x* and a point X; and an inductor L is connected between point X and output terminal OT2*y*.

The assembly consisting of transistors Q1*a* and Q1*b*, feedback transformers FT1*a* and FT1*b*, and output terminals OT1*x* and OT1*y* is referred to as auxiliary inverter Ia. The assembly consisting of transistors Q2*a*and Q2*b*, feedback transformers FT2*a* and FT2*b*, and output terminals OT2*x* and OT2*y* is referred to as main inverter Im.

A resistor R1 is connected between the B+ bus and a junction DJ; and a capacitor C1 is connected between junction DJ1 and the B− bus. A Diac D1 is connected between junction DJ1 and the base of transistor Q1*b*. A diode D1*x* is connected with its anode to junction DJ1 and with its cathode to junction J1.

A resistor R2 is connected between the B+ bus and a junction DJ2; and a capacitor C2 is connected between junction DJ2 and the B− bus. A Diac D2 is connected between junction DJ2 and the base of transistor Q2*b*; and a diode D×2 is connected with its anode to junction DJ2 and with its cathode to junction J2.

Primary winding Wp of a transformer T is connected with inverter output terminals OT1*x* and OT1*y*. Secondary winding Ws1 of transformer T is connected with lamp terminals LT1*a* and LT1*b* of a fluorescent lamp FL; and secondary winding Ws2 of transformer T is connected with lamp terminals LT2*a* and LT2*b* of fluorescent lamp FL.

Lamp terminal LT1*a* is connected with output terminal OT2*x* by way of primary winding CT1*p* of a first control transformer CT1. Lamp terminal LT2*a* is connected with point X by way of primary winding CT2*p* of a second control transformer CT2. A Varistor V is connected between point X and output terminal OT2*x*.

A first auxiliary transistor Q1 is connected with its collector to the base of transistor Q2*b* and with its emitter to the B− bus. A second auxiliary transistor Q2 is connected with its emitter to the B− bus and with its collector to the emitter of a third auxiliary transistor Q3. The collector of third auxiliary transistor Q3 is connected with a point Y.

A resistor R3 is connected between the base of transistor Q1 and the B− bus; and a series-combination of a Diac D3 and a resistor R4 is connected between point Y and the base of transistor Q1.

A capacitor C3 is connected between junction J2 and the cathode of a diode D4. The anode of diode D4 is connected with the B− bus. A resistor R5 is connected between the cathode of diode D4 and point Y; and a capacitor C4 is connected between point Y and the B− bus.

Secondary winding CT1*s* of control transformer CT1 is connected between the emitter of transistor Q3 and the anode of a diode D6. The cathode of diode D6 is connected by way of a resistor R8 to the base of transistor Q3. A resistor R9 is connected between the base and the emitter of transistor Q3; and a capacitor C6 is connected between the cathode of diode D6 and the emitter of transistor Q3.

Secondary winding CT2s of control transformer CT2 is connected between the emitter of transistor Q2 and the anode of a diode D5. The cathode of diode D5 is connected by way of a resistor R6 to the base of transistor Q2. A resistor R7 is connected between the base and the emitter of transistor Q2; and a capacitor C5 is connected between the cathode of diode D5 and the emitter of transistor Q2.

Details of Operation

The operation of the ballast arrangement of FIG. 1 may be further explained as follows.

FIG. 1 shows two half-bridge inverters: an auxiliary inverter Ia consisting of transistors Q1*a* and Q1*b* with their respective saturable positive feedback transformers FT1*a* and FT1*b*; and a main inverter Im consisting of transistors Q2*a* and Q2*b* with their respective saturable positive feedback transformers FT2*a* and FT2*b*. Both inverters use capacitors Ca and Cb to provide for an effective center-tap between the B− bus and the B+ bus—this center-tap being junction JC.

Both inverters are capable of self-oscillation by way of positive feedback. However, to oscillate, each inverter has to be triggered into oscillation. When they do oscillate, the frequency of oscillation is about 30 kHz. For further explanation of the operation of this type of inverter, reference is made to U.S. Pat. No. 4,184,128 to Nilssen, and particularly to FIG. 8 thereof.

Inverter Ia is triggered into oscillation a few milliseconds after application of power from source S—with the length of the delay being determined by the time it takes for capacitor C1 to charge to a voltage of magnitude high enough to cause Diac D1 to break down and to provide a trigger pulse to the base of transistor Q1*b*.

By way of transformer T, the output from inverter Ia is applied to the cathodes of fluorescent lamp FL, thereby conditioning this lamp and making it ready to conduct. For a typical fluorescent lamp, this conditioning takes from 1.0 to 1.5 second, after which time the lamp cathodes have reached incandescence and are capable of adequate electron emission.

Inverter Im is triggered into oscillation about 1.5 seconds after initial application of power from source S. Thus, by the time inverter Im starts oscillating, the fluorescent lamp has become fully conditioned and is ready to start without further delay.

That is, under normal circumstances, as soon as main inverter Im starts to oscillate, the fluorescent lamp instantly ignites (although not in normal instant-start fashion)—having by that time been fully conditioned to conduct. However, if the lamp does not ignite, the inverter ceases to oscillate within about 25 milli-seconds—as explained hereinbelow.

Inverter Im can be triggered out of oscillation as well. This is accomplished by way of charging capacitor C4 to a voltage of magnitude high enough to cause Diac D3 to break down; which, in turn, provides base current to transistor Q1, thereby causing this transistor Q1 to provide a momentary short circuit between the base and the emitter of transistor Q2*b*; which short circuit momentarily removes the positive feedback, thereby causing oscillation to cease.

As soon as inverter Im starts to oscillate, a 30 kHz square wave voltage appears at junction J2; which voltage is applied by way of capacitor C3 to rectifier D4. Thus, immediately after onset of oscillation of Im, capacitor C4 starts to charge toward the point where Diac D3 will break down. The time to reach that point is determined by the values of resistor R5 and capacitor C4, and is chosen to be about 25 milli-seconds.

Thus, by way of the arrangement comprising elements C3, D4 R5, C4, R4 and D3, inverter Im is made operative to squelch its own oscillation within about 25 milli-seconds after it starts. In other words, absent other factors, inverter Im would operate in such manner as to oscillate for a period of about 25 milli-seconds each time after having been quiescent for about 1.5 seconds.

But, since a fluorescent lamp can not reasonably operate by being powered only for 25 milli-seconds out of each 1.5 seconds, arrangements have been provided by which the otherwise automatic squelching of the oscillation is prevented from taking place as long as current flows through primary winding CT1*p* of current transformer CT1, as well as through primary winding CT2*p* of current transformer CT2; which is to say that the automatic squelching of the oscillation is prevented from taking place as long as current is flowing from both lamp terminal pairs.

Current through primary winding CT1*p* causes current to flow from secondary winding CT1*s*, thereby (by way of diode D6, capacitor C6 and resistor R8) to provide base current to transistor Q3 of such amount as to cause this transistor to become fully conductive.

Likewise, current through primary winding CT2*p* causes current to flow from secondary winding CT2*s*, thereby (by way of diode D5, capacitor C5 and resistor R6) to provide base current to transistor Q2 of such amount as to cause this transistor to become fully conductive.

With both transistors Q2 and Q3 fully conductive, capacitor C4 is prevented from being charged; which means that the otherwise automatic squelching of the oscillation of inverter Im is prevented from taking place for as long as current is flowing through the primary windings of both current transformers CT1 and CT2.

Thus, as long as lamp current is flowing into lamp terminal pair LT1*a*/LT1*b*, as well as into lamp terminal pair LT2*a*/LT2*b*, inverter Im will continue to oscillate once it has started.

However, if current is interrupted in its flow either into lamp terminal pair LT1*a*/LT1*b* or into lamp terminal pair LT2*a*/LT2*b*, inverter Im will be triggered out of oscillation within about 25 milli-seconds; which is to say that if either transistor Q2 or transistor Q3 ceases to be conductive, inverter Im will not be prevented from triggering itself out of oscillation.

And, of course, with inverter Im disabled, no voltage of substantial magnitude will be present between earth ground and either of lamp terminal pairs LT1*a*/LT1*b* and LT2*a*/LT2*b*; which is to say that both lamp terminal pairs are substantially free of electric shock hazard.

Additional Comments (a) To prevent redundant triggering of inverter Ia, diode D×1 is placed between junctions DJ1 and J1. Similarly, to prevent redundant triggering of inverter Im, diode D×2 is placed between junctions DJ2 and J2.

In this connection, it should be noted that—by way of diode D×2—the very oscillation of inverter Im automatically causes capacitor C2 to discharge; which implies that each time after the inverter has been stopped from oscillation (i.e., disabled), capacitor C2 has to be recharged all the way from "scratch".

(b) In some situations it may be advantageous to remove the conditioning voltage after the initial lamp conditioning has been accomplished. In particular, it may be advantageous for energy-efficiency reasons to remove the cathode heating power after the lamp has ignited.

This can be accomplished simply by making provisions for inverter Ia to be disabled as soon as lamp current flows through the primary windings of transformers CT1 and CT2; which, in turn, can be accomplished very simply by placing an auxiliary transistor across the base-emitter junction of transistor Q1*b* in manner similar to that in which transistor Q1 is placed across the base-emitter junction of transistor Q2*b*, and by connecting a resistor between the collector of transistor Q3 and the base of this auxiliary transistor.

If it were to be automatically disabled in the manner suggested, inverter Ia would equally automatically reinitiate its oscillation immediately upon cessation of the flow of lamp current through the primary windings of transformers CT1 and CT2.

(c) Varistor V is chosen such that it will limit the voltage developing across tank capacitor C to a magnitude that is suitable for proper lamp ignition; which voltage might be of magnitude about twice that of the lamp's normal operating voltage.

If for some reason the fluorescent lamp should not ignite, the magnitude of the voltage developing across capacitor C (as resulting from Q-multiplication) would be limited by the voltage-clamping characteristics of Varistor V.

(d) As long as power is flowing through the Varistor, the rate of power dissipation therein is very large: about twice as large as the normal full power applied to the lamp when it is operating. With this full power being typically on the order of 80 Watt for a pair of F40/T12 fluorescent lamps (which is the most commonly occurring fluorescent lamp load), the implication is that the Varistor has to be able to handle a dissipation of about 160 Watt. This amount of power dissipation is well within the limits of an ordinary inexpensive Varistor, as long as the average power dissipation does not exceed about 2 Watt; which, in the present arrangement, it will not since the 160 Watt power dissipation can only occur at a maximum duty-rate of 25 milli-seconds out of every 1.5 seconds (or every 1500 milli-seconds).

(e) Thus, as long as any output current from inverter Im is prevented from flowing through the primary windings of both control transformers CT1 and CT2, the output voltage provided between terminals LT1*a* and LT2*a* will consist of intermittent pulses of 30 kHz voltage of magnitude determined by the voltage-limiting characteristics of the Varistor. These pulses will be of about 25 milli-seconds duration; and they will be spaced apart by about 1500 milli-seconds. As a result, the RMS magnitude of the voltage then provided between terminals LT1*a* and LT2*a* will be reduced by the square root of the ratio between 1500 and 25, or by a factor of about 7.25, as compared to the RMS magnitude of the 30 kHz voltage simply as limited in magnitude by the Varistor.

(f) It is noted that source S, being an ordinary electric utility power line, is connected in circuit with earth ground.

(g) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

What is claimed is:

1. A ballast for a fluorescent lamp, comprising:

source means: (i) having control input means receptive of a control signal, (ii) being controllably operable to provide a current-limited output voltage between a pair of output terminals, (iii) being adapted to exist in either of two modes of operation: a first mode in which the output voltage consists of brief periods of relatively high-magnitude voltage interrupted with short periods of relatively low-magnitude voltage and a second mode in which the output voltage consists of a substantially constant-magnitude voltage, and (iv) being operative to exist in the second mode only if a control signal is supplied to the control input means;

lamp connect means operative to permit connection of a fluorescent lamp between the pair of output terminals; and control means connected in circuit with the output terminals and the control input means, the control means being responsive to current flowing from the output terminals and operative to provide a control signal to the control input means as long as current is indeed flowing from both output terminals;

whereby, if current is prevented from flowing from at least one of the output terminals, no control signal is provided and the source means will then exist in its first mode of operation.

2. The ballast of claim 1 wherein the duration of each of the brief periods is shorter than that of each of the short periods.

3. The ballast of claim 2 whereon the duration of each of the brief periods is on the order of 25 milli-seconds and the duration of each of the short periods is on the order of 1500 milli-seconds.

4. The ballast of claim 1 wherein, during the second mode of operation, the voltage existing between the output terminals is an AC voltage of frequency substantially higher than that of the voltage on an ordinary electric utility power line.

5. The ballast of claim 1 wherein the magnitude of the voltage existing between either of the output terminals and earth ground is so large as to constitute a potential electric shock hazard to a person being in contact with earth ground.

6. A ballast for a gas discharge lamp, comprising:

source means operative to provide a current-limited output voltage at a pair of output terminals, the source means having control input means receptive of a control input signal, the output voltage being provided in either of two modes: (i) with no control signal provided to the control input means, a first mode in which the output voltage is provided in the form of brief bursts of relatively high-magnitude AC voltage spaced apart by periods of relatively low-magnitude voltage, and (ii) with a control signal provided to the control input means, a second mode in which the output voltage is provided in the form of a substantially continuous AC voltage;

connect means operative to permit disconnectable connection of a gas discharge lamp to the output terminals; and control means connected in circuit with the control input means as well as with the connect means, the control means being responsive to current flowing from the output terminals and operative to provide a control signal to the control input means, but only for as long as current is flowing from these output terminals.

7. The ballast of claim 6 wherein the duration of each one of the bursts of AC voltage is substantially longer than that of the period of the AC voltage.

8. The ballast of claim 6 wherein the duration of each one of the bursts of AC voltage is substantially shorter than that of each one of the periods of relatively low-magnitude voltage.

9. The ballast of claim 6 wherein the frequency of the AC voltage is substantially higher than the frequency of the voltage normally present on an ordinary electric utility power line.

10. The ballast of claim 6 wherein the gas discharge lamp is a fluorescent lamp operative to ignite and to reach a current-conductive state during a single one of the bursts of AC voltage.

11. The ballast of claim 6 wherein the control means is operative to provide a control signal only when current is flowing from both output terminals.

12. The ballast of claim 6 wherein the source means comprises a frequency converter means adapted to connect with an ordinary electric utility power line.

13. The ballast of claim 6 wherein the duration of each one of the bursts of AC voltage is long enough to permit the gas discharge lamp to ignite and become conductive.

14. The ballast of claim 6 combined with auxiliary power supply means and wherein: (i) the gas discharge lamp is a rapid-start fluorescent lamp having thermionic cathodes, (ii) the magnitude of the relatively high-magnitude AC voltage is inadequate to ignite the fluorescent lamp except when its cathodes are incandescent, and (iii) the auxiliary power supply is connected with the cathodes and operative to make them incandescent within a brief period, the duration of this brief period being longer than that of one of the bursts of AC voltage.

15. The ballast of claim 14 wherein the duration of the brief period is shorter than that of each one of the periods of relatively low-magnitude voltage.

16. An arrangement comprising:

source means having control input means receptive of a control signal, the source means being operative: (i) to provide intermittent bursts of AC voltage between a pair of output terminals for as long as no control signal is received by the control input means, each burst being of relatively brief duration and followed by a relatively long period of quiescence, and (ii) to provide a substantially non-intermittent AC voltage between the output terminals for as long as a control signal is received by the control input means;

means by which to permit connection of a lamp load with the output terminals; and control means connected in circuit with the control input means as well as with the output terminals, the control means being responsive to current flowing from the output terminals and operative in response to this current to provide a control signal to the control input terminals;

whereby: (i) as long as current flows from both output terminals, the voltage present between the output terminals is a substantially non-intermittent AC voltage having a first RMS magnitude, and, (ii) as long as no current flows from one of the output terminals, the voltage present between the output terminals consists of intermittent burst of AC voltage having a second RMS magnitude; the first RMS magnitude being substantially higher than the second RMS magnitude, the period over which RMS magnitude is calculated includes an equal whole number of bursts and periods of quiescence.

* * * * *